US006523352B1

(12) United States Patent
Takahashi et al.

(10) Patent No.: US 6,523,352 B1
(45) Date of Patent: Feb. 25, 2003

(54) PIPING SUPPORT OF GAS TURBINE STEAM COOLED COMBUSTOR

(75) Inventors: Syuichi Takahashi, Sendai (JP); Yoshiaki Nishimura, Sendai (JP); Hiroyuki Fujita, Sendai (JP); Hiroyuki Ogasawara, Sendai (JP); Noboru Yamada, Kitakanbara-gun (JP); Ikuo Ando, Kitakanbara-gun (JP); Haruhiko Kondo, Kitakanbara-gun (JP); Kazunori Chiba, Kitakanbara-gun (JP); Yoichi Iwasaki, Takasago (JP); Masayuki Takahama, Takasago (JP); Koichiro Yanou, Takasago (JP)

(73) Assignees: Tohoku Electric Power Company, Inc., Miyagi (JP); Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/624,179

(22) Filed: Jul. 24, 2000

(30) Foreign Application Priority Data

Aug. 2, 1999 (JP) ..... 11-218588

(51) Int. Cl.[7] ..... F02C 7/20; F16L 55/00

(52) U.S. Cl. ..... 60/796; 60/730; 138/103; 248/62

(58) Field of Search ..... 60/39.31, 796, 60/730; 248/637, 49, 58, 62; 138/108

(56) References Cited

U.S. PATENT DOCUMENTS 2,546,533 A * 3/1951 Williamson ..... 138/108
4,487,014 A * 12/1984 Vinciguerra ..... 60/39.31
4,586,564 A * 5/1986 Hagemeister ..... 165/159
5,014,940 A * 5/1991 Sherman ..... 248/62
5,192,039 A * 3/1993 Williams ..... 2/175.9
5,369,952 A * 12/1994 Walters ..... 60/39.31

FOREIGN PATENT DOCUMENTS

JP 8-93965 4/1996

* cited by examiner

*Primary Examiner*—Charles G. Freay
(74) *Attorney, Agent, or Firm*—Wenderoth, Lind & Ponack, L.L.P.

(57) ABSTRACT

Piping support of a gas turbine steam cooled combustor is improved such that even when the piping support is damaged by combustion vibration, dropping of the piping support from the piping is prevented, so as to avoid intrusion of fractions of the piping support into turbine portion. An outer fitting member is fixed to a wall surface of a tail tube by welds. A ring is pinched inside the outer fitting member to be fixed by welds. The ring having an inner diameter slightly larger than an outer diameter of steam piping is fitted around the steam piping to be fixed by welds at three places. The steam piping is fixed to the ring, the ring is fixed to the outer fitting member and the outer fitting member is fixed to the tail tube. Thus, the steam piping is supported to the tail tube and even when the welds are detached by combustion vibration, no case of the outer fitting member dropping from the steam piping occurs.

2 Claims, 8 Drawing Sheets

PIPING SUPPORT OF GAS TURBINE STEAM COOLED COMBUSTOR

BACKGROUND OF THE INVENTION

1. Field of the Invention

The present invention relates generally to a piping support of a gas turbine steam cooled combustor and more particularly to a piping support so improved that even when the piping support is damaged by combustion vibration, etc., dropping thereof is prevented so as to avoid an intrusion of fractions into a turbine portion, thereby preventing an accident including gas turbine blades, etc.

2. Description of the Prior Art

FIGS. 5(*a*) and (*b*) show an example of a gas turbine steam cooled combustor to which piping supports in the prior art are applied, wherein FIG. 5(*a*) is a plan view, and FIG. 5(*b*) is a side view. In FIGS. 5(*a*) and (*b*), a tail tube 102 of the combustor comprises a combustion gas outlet 104, through which a high temperature combustion gas is supplied into a gas path of the gas turbine. The tail tube 102 also comprises a by-pass pipe connecting port 103 for taking air from a turbine cylinder and a steam piping 101 is disposed around the by-pass pipe connecting port 103. The steam piping 101 is a piping through which cooling steam is supplied from a steam supply port 105 into a cooling passage provided on an inner circumferential wall of the tail tube 102 of the combustor and, after having cooled the wall of the tail tube 102 and elevated of temperature, is recovered from a steam recovering port 106. The steam piping 101 is supported by piping supports 110, 111, 112 and each of the piping supports 110, 111, 112 is fixed to an outer wall of the tail tube 102 of the combustor.

FIGS. 6(*a*) to (*c*) show the piping support 110, wherein FIG. 6(*a*) is a front view as seen from arrows on line D—D of FIG. 5(*a*), FIG. 6(*b*) is a plan view and FIG. 6(*c*) is a side view. In FIGS. 6(*a*) to (*c*), the steam piping 101 is supported such that the steam piping 101 is pinched between upper and lower clamps 121, 122 via a spacer 125 disposed around the steam piping 101. The upper and lower clamps 121, 122 are fastened together by bolts/nuts 123, 124 and the lower clamp 122 is fixed by welding to the outer wall of the tail tube 102 via a fitting member 122*a*. The present example is an example where the lower clamp 122 has its one end fitted with the fitting member 122*a* to thereby support the steam piping 101 at the one end.

FIGS. 7(*a*) to (*c*) show the piping support 111, wherein FIG. 7(*a*) is a front view seen from arrows on line E—E of FIG. 5(*a*), FIG. 7(*b*) is a plan view and FIG. 7(*c*) is a side view. In FIGS. 7(*a*) to (*c*), like FIGS. 6(*a*) to (*c*), the steam piping 101 is supported such that the steam piping 101 is pinched between upper and lower clamps 221, 222 via a spacer 225 disposed around the steam piping 101. The upper and lower clamps 221, 222 are fastened together by bolts/nuts 223, 224 and a central portion of the lower clamp 222 is fixed by welding to the outer wall of the tail tube 102 via a fitting member 222*a*. The present example is an example where the lower clamp 222 has its central portion fitted with the fitting member 222*a* to thereby support the steam piping 101 at the central portion.

FIGS. 8(*a*) to (*d*) show the piping support 112, wherein FIG. 8(*a*) is a front view seen from arrows on line F—F of FIG. 5(*a*), FIG. 8(*b*) is a plan view, FIG. 8(*c*) is a side view and FIG. 8(*d*) is a bottom view. In FIGS. 8(*a*) to (*d*), the steam piping 101 is supported such that the steam piping 101 is pinched between upper and lower clamps 321, 322 via a spacer 325 disposed around the steam piping 101. The upper and lower clamps 321, 322 are fastened together by bolts/nuts 323, 324 and the lower clamp 322 is fixed by welding to the outer wall of the tail tube 102 via fitting members 322*a*, 322*b* joined together in an L-shape. The present example is an example where the fitting members 322*a*, 322*b* joined together in the L-shape are interposed to thereby support the steam piping 101.

As mentioned above, the conventional steam piping 101 is fixedly supported using the upper and lower clamps, spacer and bolts/nuts so as to defend against vibration, etc., wherein the lower clamp is fixed to the wall surface of the tail tube 102 via the fitting member 122*a* or 222*a*, or the fitting members 322*a*, 322*b*, selected corresponding to a curved surface of the tail tube 102.

In the conventional gas turbine steam cooled combustor as mentioned above, the steam piping for the cooling steam is provided on the wall surface of the tail tube to be supported such that the steam piping is fixed to the piping support and the piping support is fixed by welding to the wall surface of the tail tube. The piping support comprises the upper and lower clamps, both made in a C-shape, and the piping support is so constructed that the steam piping is pinched between the upper and lower clamps via the spacer. The upper and lower clamps are fastened together by the bolts/nuts and the piping support is fixed to the wall surface of the tail tube. While the gas turbine is operated, a combustion vibration occurs and in the piping support so constructed, there may be a case where the fixation of the fitting member is loosened and should the fitting member be damaged and detached from the wall surface of the tail tube or the bolts/nuts be loosened by vibration, for example, then the clamps may drop out from the piping so that fractions thereof may enter a turbine portion together with combustion gas and in such a case, there is a large possibility that the gas turbine will be seriously damaged with regard to the blades, etc.

SUMMARY OF THE INVENTION

In view of the mentioned problem in the prior art, it is an object of the present invention to provide a piping support of a gas turbine steam cooled combustor in which the piping support supporting a steam piping has a construction so improved that even when the piping support is damaged by combustion vibration of the combustor or the like, dropping of the piping support out from the steam piping is prevented, so as to avoid an intrusion of fractions of the piping support into a turbine portion to thereby prevent an accident concerning gas turbine blades, etc.

In order to achieve the object, the present invention provides the following.

A piping support of a gas turbine steam cooled combustor, characterized in that the piping support comprises a ring fitted around a steam piping so as to be fixed to each other and an outer fitting member formed in a U-shape so that the ring makes contact with an inner circumferential surface portion of the outer fitting member to be fixed to each other. The outer fitting member at both ends thereof opposite to the inner circumferential surface portion is fixed to a wall surface of a tail tube.

In the piping support of the present invention, the ring is fitted around the steam piping and the steam piping at the outer circumferential surface thereof is fixed to the ring by welding or the like. The ring at the outer circumferential surface thereof makes contact with the inner circumferential surface portion of the outer fitting member formed in the U-shape so as to be fixed to each other by welding or the like. Thus, the steam piping is supported to the wall surface of the tail tube via the ring and the outer fitting member. As the ring and the outer fitting member are fixed to each other, even when the outer fitting member is detached from the wall surface of the tail tube due to fatigue by combustion vibration or the like, the outer fitting member is supported by the steam piping via the ring and no case of the outer fitting member being dropped from the piping occurs. Hence, there arises no case of dropped fractions of the piping support coming into the gas path of the gas turbine and turbine blades and the like are prevented from being damaged.

DESCRIPTION OF THE PREFERRED EMBODIMENTS

Figure 1A:
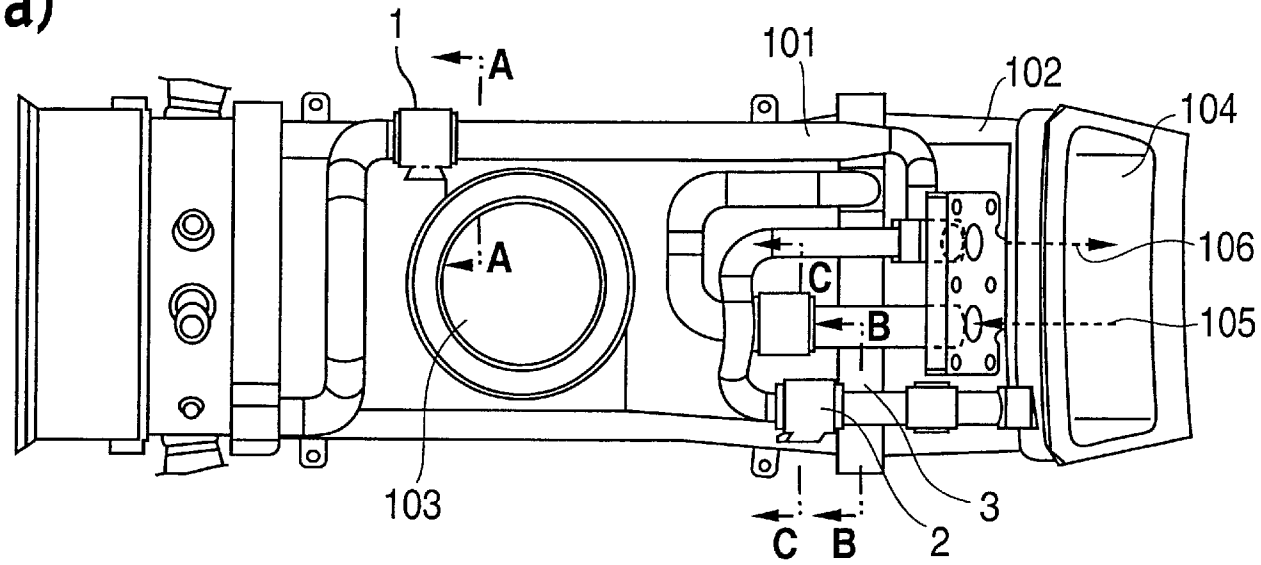
FIGS. 1(*a*) and (*b*) show an example of a gas turbine steam cooled combustor to which piping supports of embodiments of the present invention are applied, wherein FIG. 1(*a*) is a plan view and FIG. 1(*b*) is a side view.
Figure 1B:
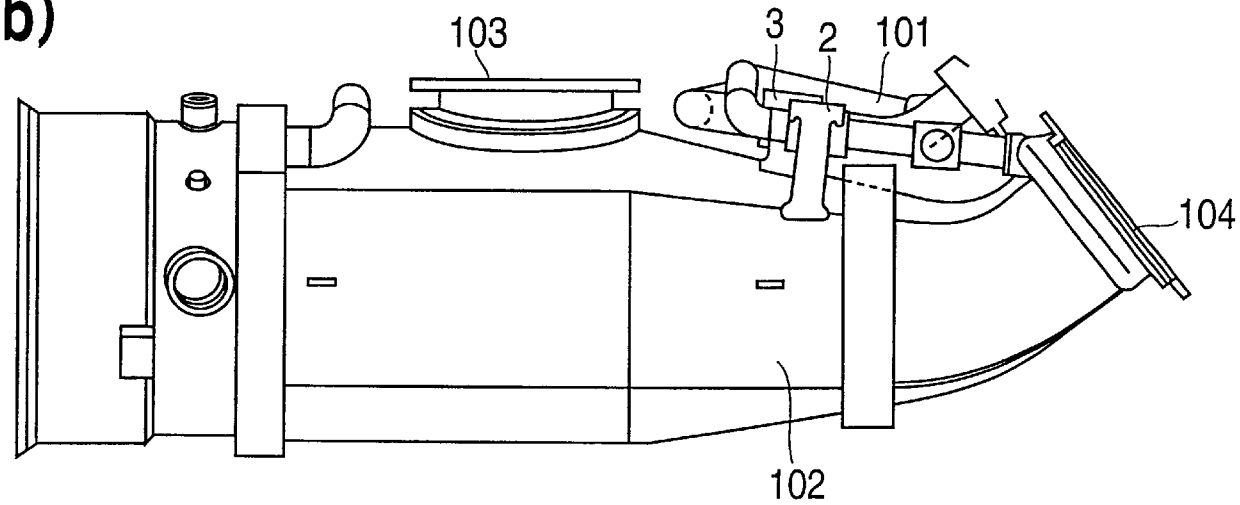
Figure 2A:
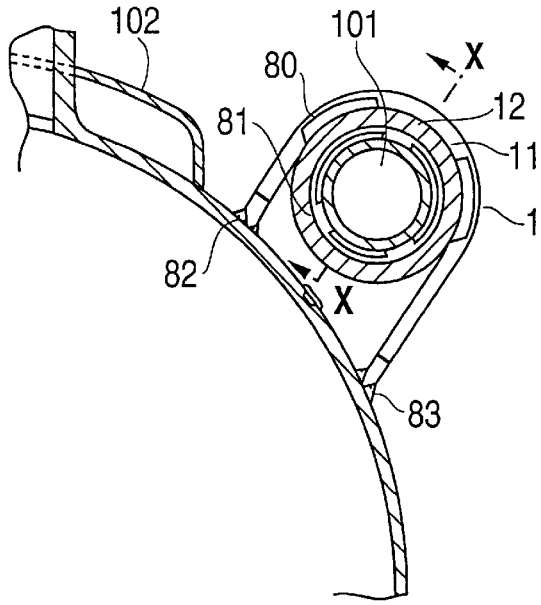
FIGS. 2(*a*) to (*d*) show one piping support of the embodiments of the present invention, wherein FIG. 2(*a*) is a front view seen from arrows on line A—A of FIG. 1(*a*), FIG. 2(*b*) is a cross sectional view taken on line X—X of FIG. 2(*a*), FIG. 2(*c*) is a right hand side view and FIG. 2(*d*) is a left hand side view.
Figure 2B:
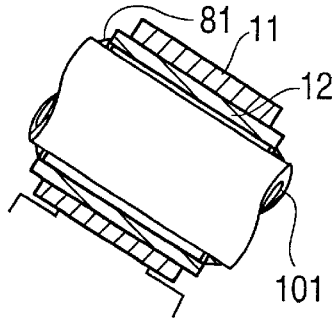
Figure 2C:
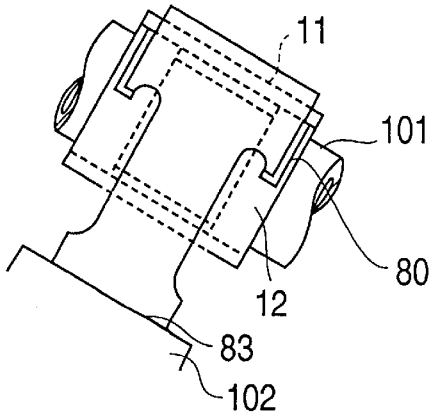
Figure 2D:
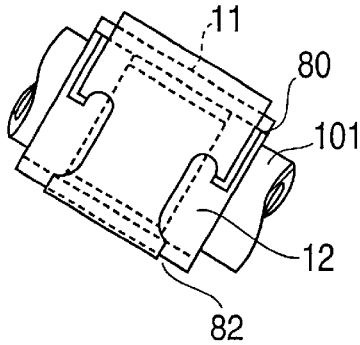
Figure 5A:
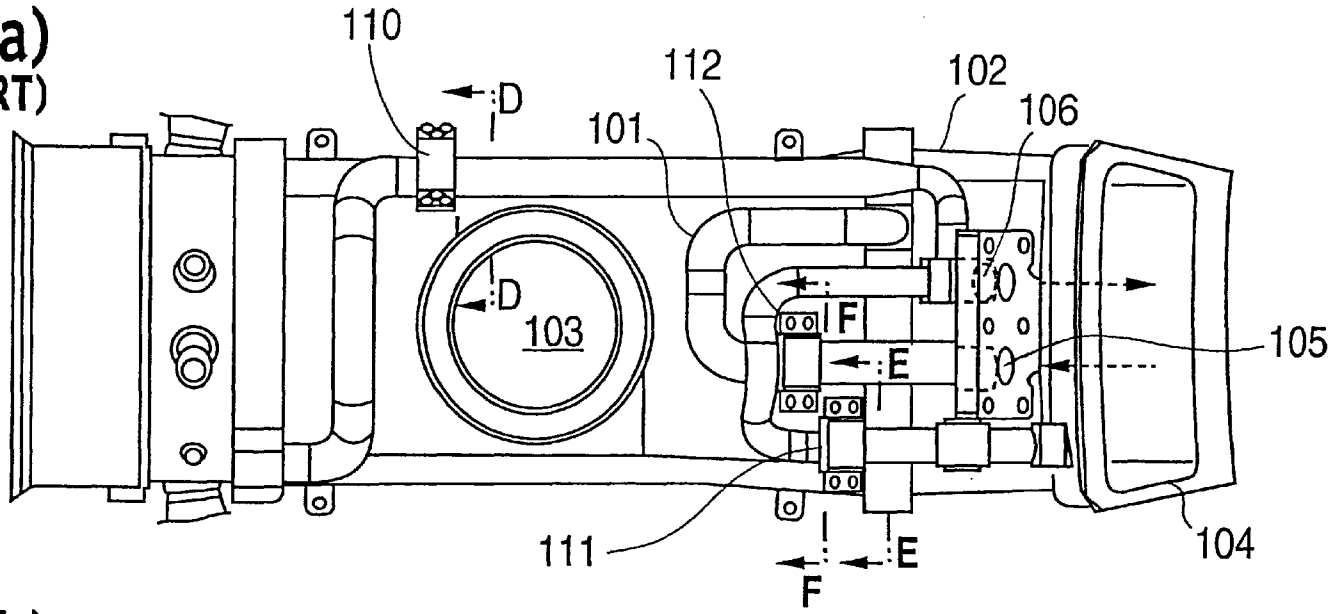
FIG. 5(a) (PRIOR ART)
FIGS. 5(*a*) and (*b*) show an example of a gas turbine steam cooled combustor to which piping supports in the prior art are applied, wherein FIG. 5(*a*) is a plan view and FIG. 5(*b*) is a side view.
Figure 5B:
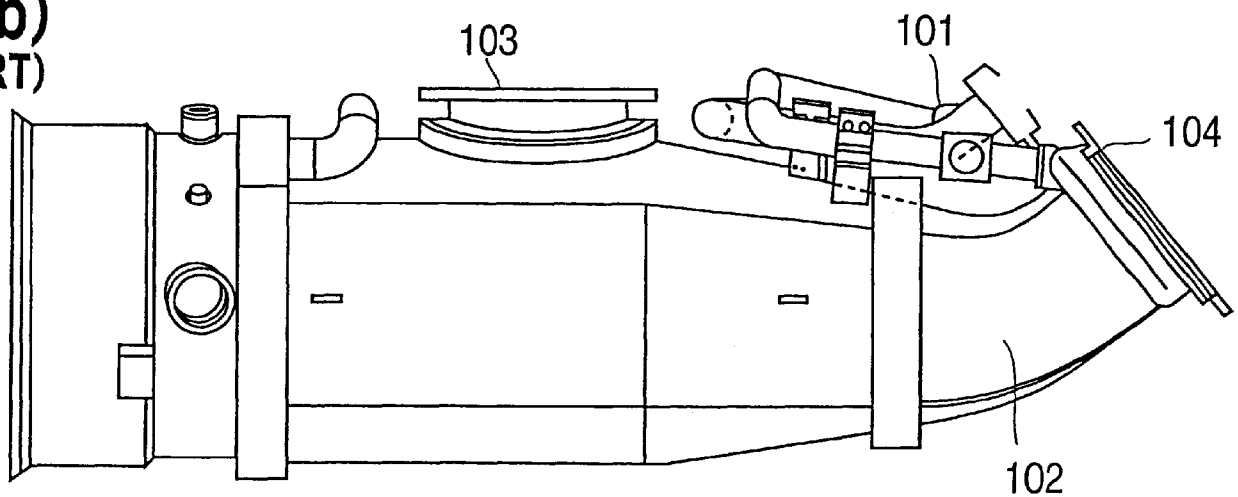
FIG. 5(b) (PRIOR ART)
Figure 6A:
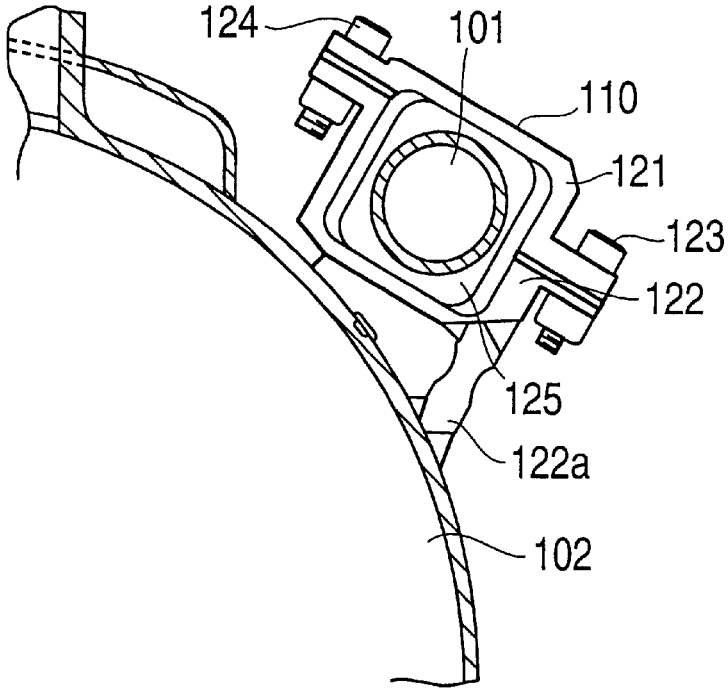
FIG. 6(a) (PRIOR ART)
FIGS. 6(*a*) to (*c*) show one piping support of those shown in FIG. 5(*a*), wherein FIG. 6(*a*) is a front view seen from arrows on line D—D of FIG. 5(*a*), FIG. 6(*b*) is a plan view and FIG. 6(*c*) is a side view.
Figure 6B:
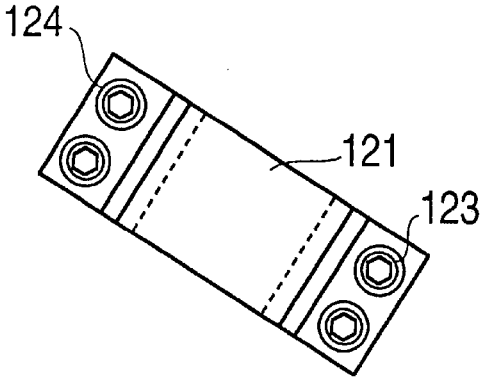
FIG. 6(b) (PRIOR ART)
Figure 6C:
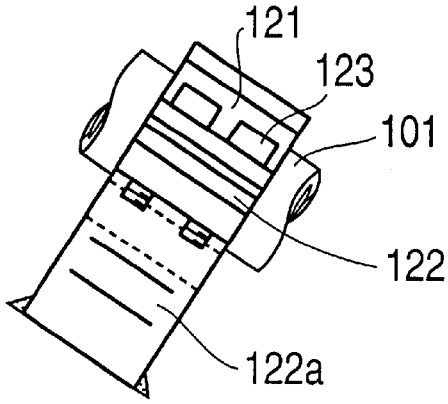
FIG. 6(c) (PRIOR ART)
Figure 7A:
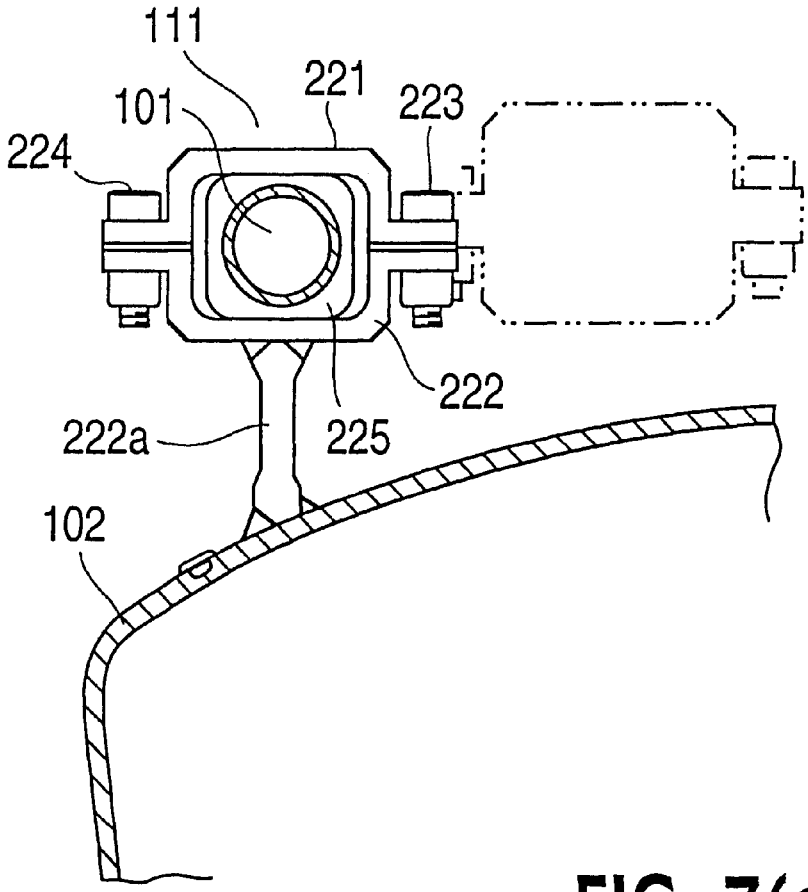
FIG. 7(a) (PRIOR ART)
FIGS. 7(*a*) to (*c*) show another piping support of those shown in FIG. 5(*a*), wherein FIG. 7(*a*) is a front view seen from arrows on line E—E of FIG. 5(*a*), FIG. 7(*b*) is a plan view and FIG. 7(*c*) is a side view.
Figure 7C:
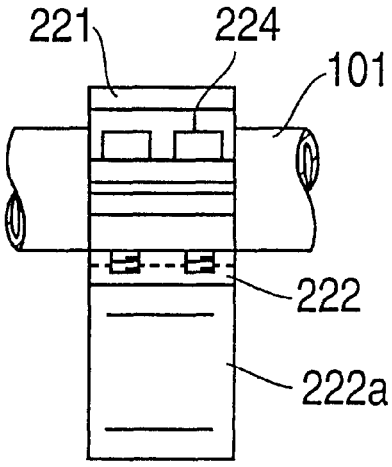
FIG. 7(c) (PRIOR ART)
Figure 7B:
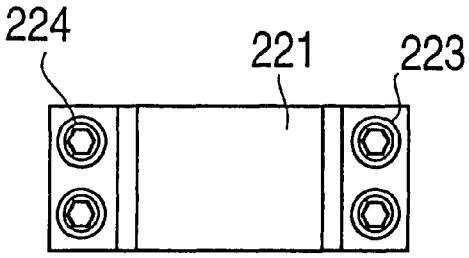
FIG. 7(b) (PRIOR ART)
Figure 8A:
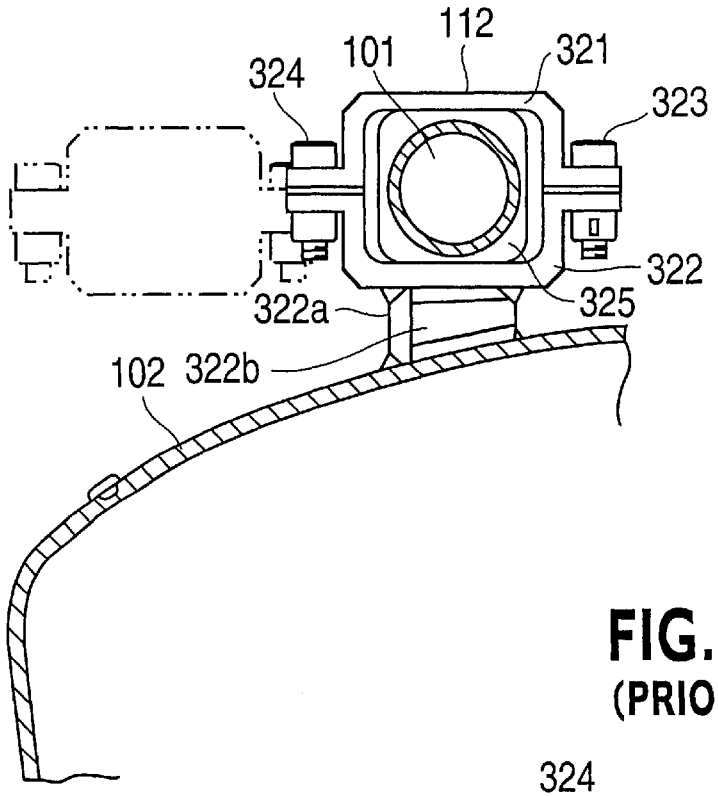
FIG. 8(a) (PRIOR ART)
FIGS. 8(*a*) to (*c*) show still another piping support of those shown in FIG. 5(*a*), wherein FIG. 8(*a*) is a front view seen from arrows on line F—F of FIG. 5(*a*), FIG. 8(*b*) is a plan view, FIG. 8(*c*) is a side view and FIG. 8(*d*) is a bottom view.
Figure 8B:
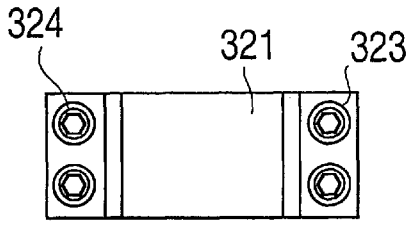
FIG. 8(b) (PRIOR ART)
Figure 8C:
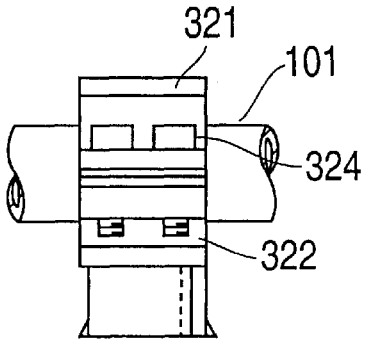
FIG. 8(c) (PRIOR ART)
Figure 8D:
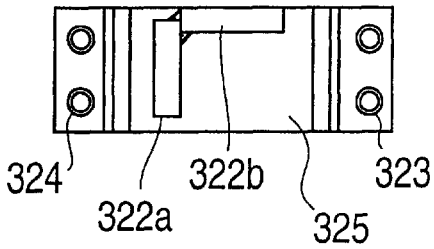
FIG. 8(d) (PRIOR ART)

Herebelow, embodiments according to the present invention will be described concretely with reference to Figures. FIGS. 1(*a*) and (*b*) show an example of a gas turbine steam cooled combustor to which piping supports of embodiments of the present invention are applied, wherein FIG. 1(*a*) is a plan view and FIG. 1(*b*) is a side view. In FIGS. 1(*a*) and (*b*), the parts and components designated by numerals 101 to 106 are same in the function as those shown in FIGS. 5(*a*) and (*b*) with description thereon being omitted, and featured portions of the present invention, which are piping supports designated by numerals 1, 2, 3, will be described in detail.

FIGS. 2(*a*) to (*d*) show a piping support 1, wherein FIG. 2(*a*) is a front view seen from arrows on line A—A of FIG. 1(*a*). FIG. 2(*b*) is a cross sectional view taken on line X—X of FIG. 2(*a*), FIG. 2(*c*) is a right hand side view and FIG. 2(*d*) is a left hand side view. In FIGS. 2(*a*) to (*d*), numeral 1 designates the entire piping support, numeral 11 designates an outer fitting member, which is formed in a U-shape, and numeral 12 designates a ring, which inscribes an inner circumferential surface portion of the outer fitting member 11. The ring 12 has an inner diameter slightly larger than an outer diameter of the steam piping 101 so that the ring 12 may be fitted around the steam piping 101.

The outer fitting member 11 and the ring 12 are joined together to be fixed by welds 80 at two places where both side edge portions of the outer fitting member 11 make contact with an outer circumferential surface of the ring 12. The ring 12 and the steam piping 101 are joined together to be fixed by welds 81 at three places where an inner circumferential surface of the ring 12 makes contact with an outer circumferential surface of the steam piping 101. Further, the outer fitting member 11 is joined to a curved outer wall surface of the tail tube 102 by welds 82, 83 at two places where both end portions of the outer fitting member 11 make contact with the curved outer wall surface of the tail tube 102. Thus, the steam piping 101 is supported to the tail tube 102.

In the piping support 1 of the above construction, the steam piping 101 is fixed to the inner circumferential surface of the ring 12 by the welds 81 at the three places. The ring 12 at the outer circumferential surface thereof is fixed to the both side edge portions of the outer fitting member 11 by the welds 80 at the two places. The outer fitting member 11 at the both end portions thereof, which are formed to the size of the height of the piping above the curved outer wall surface of the tail tube 102, is fixed to the outer wall of the tail tube 102 by welds 82, 83.

As the result of this, the steam piping 101 is supported to the outer wall of the tail tube 102 via the ring 12 and the outer fitting member 11, wherein the ring 12 and the outer fitting member 11 are joined together by the welds 80. Thus, even when both the welds 82, 83 at two places of the outer fitting member 11 are detached due to combustion vibration, etc., the outer fitting member 11 is fixed to the ring 12 and the ring 12 is fitted around, and fixed to, the steam piping 101, hence the outer fitting member 11 dropping from the steam piping 101 does not occur.

Figure 3A:
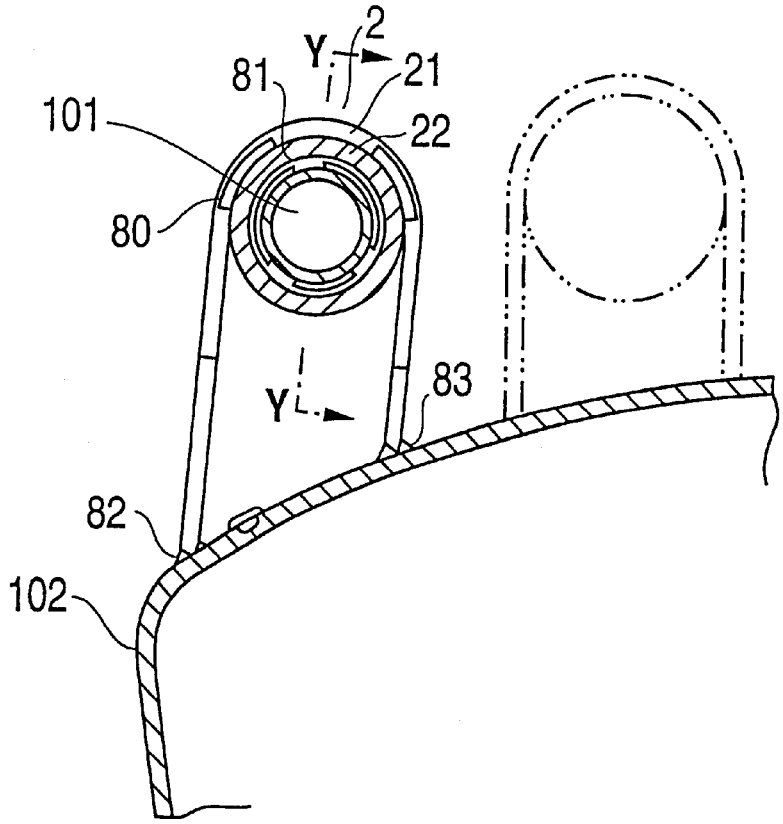
FIGS. 3(*a*) to (*c*) show another piping support of the embodiments of the present invention, wherein FIG. 3(*a*) is a front view seen from arrows on line B—B of FIG. 1(*a*), FIG. 3(*b*) is a cross sectional view taken on line Y—Y of FIG. 3(*a*) and FIG. 3(*c*) is a side view.
Figure 3B:
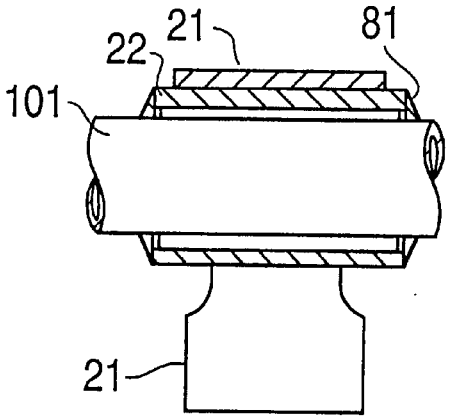
Figure 3C:
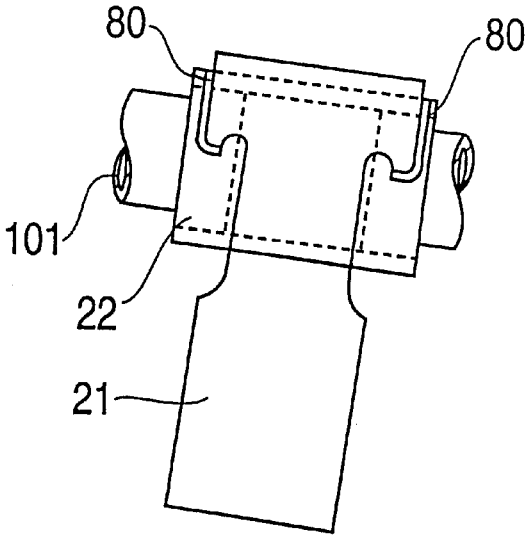

FIGS. 3(*a*) to (*c*) show a piping support 2, wherein FIG. 3(*a*) is a front view seen from arrows on line B—B of FIG. 1(*a*), FIG. 3(*b*) is a cross sectional view taken on line Y—Y of FIG. 3(*a*) and FIG. 3(*c*) is a side view. In FIGS. 3(*a*) to (*c*), numeral 2 designates the piping support, of which construction is substantially the same as that of the piping support 1, shown in FIGS. 2(*a*) to (*d*), and numeral 21 designates an outer fitting member and numeral 22 designates a ring. The ring 22 inscribes an inner circumferential surface portion of the outer fitting member 21 and has an inner diameter slightly larger that an outer diameter of the steam piping 101, so that the ring 22 may be fitted around the steam piping 101.

The outer fitting member 21 and the ring 22 are joined together to be fixed by welds 80 at two places where both side edge portions of the outer fitting member 21 make contact with an outer circumferential surface of the ring 22. The ring 22 and the steam piping 101 are joined together to be fixed by welds 81 at three places where an inner circumferential surface of the ring 22 makes contact with an outer circumferential surface of the steam piping 101. Further, the outer fitting member 21 is joined to a curved outer wall surface of the tail tube 102 by welds 82, 83 at two places where both end portions of the outer fitting member 21 make contact with the curved outer wall surface of the tail tube 102. Thus, the steam piping 101 is supported to the tail tube 102.

In the piping support 2 of the above construction, the steam piping 101 is fixed to the inner circumferential surface of the ring 22 by the welds 81 at the three places, the ring 22 at the outer circumferential surface thereof is fixed to the both side edge portions of the outer fitting member 21 by the welds 80 at the two places and the outer fitting member 21 at the both end portions thereof, which are formed to the size of the height of the piping above the curved outer wall surface of the tail tube 102, is fixed to the outer wall of the tail tube 102 by the welds 82, 83.

As the result of this, like the piping support 1 shown in FIGS. 2(*a*) to (*d*), the steam piping 101 is supported to the outer wall of the tail tube 102 via the ring 22 and the outer fitting member 21, wherein the ring 22 and the outer fitting member 21 are joined together by the welds 80. Thus, even when both the welds 82, 83 at two places of the outer fitting member 21 are detached due to combustion vibration, etc., the outer fitting member 21 is fixed to the ring 22 and the ring 22 is fitted around, and fixed to, the steam piping 101, hence no case of the outer fitting member 21 dropping from the steam piping 101 occurs.

Figure 4A:
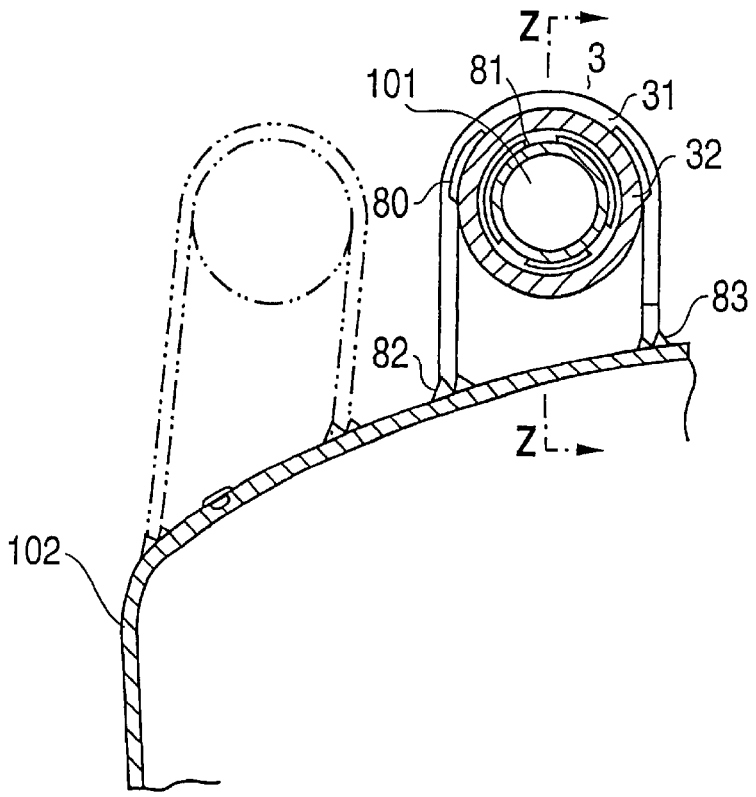
FIGS. 4(*a*) to (*c*) show still another piping support of the embodiments of the present invention, wherein FIG. 4(*a*) is a front view seen from arrows on line C—C of FIG. 1(*a*), FIG. 4(*b*) is a cross sectional view taken on line Z—Z of FIG. 4(*a*) and FIG. 4(*c*) is a side view.
Figure 4B:
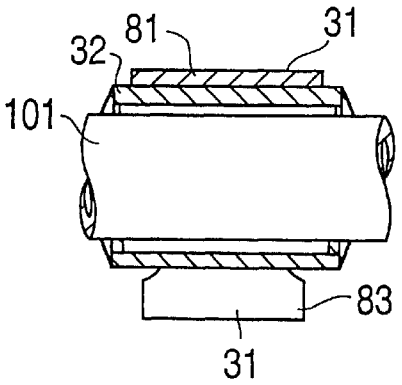
Figure 4C:
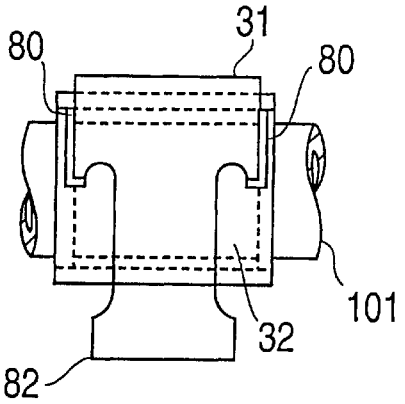

FIGS. 4(*a*) to (*c*) show a piping support 3, wherein FIG. 4(*a*) is a front view seen from arrows on line C—C of FIG. 1(*a*), FIG. 4(*b*) is a cross sectional view taken on line Z—Z of FIG. 4(*a*) and FIG. 4(*c*) is a side view. In FIGS. 4(*a*) to (*c*), numeral 3 designates the piping support, of which construction is substantially the same as those of the piping supports 1, 2 shown in FIGS. 2(*a*) to (*d*) and FIGS. 3(*a*) to (*c*), and numeral 31 designates an outer fitting member and numeral 32 designates a ring. The ring 32 inscribes an inner circumferential surface portion of the outer fitting member 31 and has an inner diameter slightly larger than an outer diameter of the steam piping 101, so that the ring 32 may be fitted around the steam piping 101.

The outer fitting member 31 and the ring 32 are joined together to be fixed by welds 80 at two places where both side edge portions of the outer fitting member 31 make contact with an outer circumferential surface of the ring 32. The ring 32 and the steam piping 101 are joined together to be fixed by welds 81 at three places where an inner circumferential surface of the ring 32 makes contact with an outer circumferential surface of the steam piping 101. Further, the outer fitting member 31 is joined to a curved outer wall surface of the tail tube 102 by welds 82, 83 at two places where both end portions of the outer fitting member 31 make contact with the curved outer wall surface of the tail tube 102. Thus, the steam piping 101 is supported to the tail tube 102.

In the piping support 3 of the above construction, the steam piping 101 is fixed to the inner circumferential surface of the ring 32 by the welds 81 at the three places, the ring 32 at the outer circumferential surface thereof is fixed to the both side edge portions of the outer fitting member 31 by the welds 80 at the two places and the outer fitting member 31 at the both end portions thereof, which are formed to the size of the height of the, piping above the curved outer wall surface of the tail tube 102, is fixed to the outer wall of the tail tube 102 by the welds 82, 83.

As the result of this, like the piping supports 1, 2 shown in FIGS. 2(*a*) to (*d*) and FIGS. 3(*a*) to (*c*), the steam piping 101 is supported to the outer wall of the tail tube 102 via the ring 32 and the outer fitting member 31, wherein the ring 32 and the outer fitting member 31 are joined together by the welds 80. Thus, even when both the welds 82, 83 at two places of the outer fitting member 31 are detached due to combustion vibration, etc., the outer fitting member 31 is fixed to the ring 32 and the ring 32 is fitted around, and fixed to, the steam piping 101, hence no case of the outer fitting member 31 dropping from the steam piping 101 occurs.

It is understood that the invention is not confined to the particular construction and arrangement of parts herein illustrated and described, but embraces such modified forms thereof as come within the scope of the following claims.

What is claimed is:

1. A piping support comprising:

a ring being fitted around and fixed to a steam piping; and an outer fitting member having a U-shape, wherein an inner curved surface portion of said outer fitting member is in contact with and is fixed to said ring, and ends of said outer fitting member opposite to said inner curved surface portion are fixed by fixing means other than a nut and a bolt to a wall surface of a tail tube as a vibrating member, wherein said ring and the steam piping and said ring and said outer fitting member, respectively, are fixed to each other by welds.

2. A piping support comprising:

a ring being fitted a steam piping so as to be adapted to cope with a thermal elongation in an axial direction of the steam piping; and an outer fitting member having a U-shape, wherein an inner curved surface portion of said outer fitting member is in contact with and is fixed to said ring via welding, and ends of said outer fitting member opposite to said inner curved surface portion are fixed via welding to a wall surface of a tail tube as a vibrating member.

* * * * *